US007705294B2

(12) United States Patent
Ramstad et al.

(10) Patent No.: US 7,705,294 B2
(45) Date of Patent: Apr. 27, 2010

(54) METHOD OF VISUALIZING TARGET OBJECTS IN A FLUID-CARRYING PIPE

(75) Inventors: Einar Ramstad, Stavanger (NO); Phil Teague, Hafrsfjord (NO)

(73) Assignee: VisuRay AS, Stravanger (NO)

( * ) Notice: Subject to any disclaimer, the term of this patent is extended or adjusted under 35 U.S.C. 154(b) by 0 days.

(21) Appl. No.: 12/405,770

(22) Filed: Mar. 17, 2009

(65) Prior Publication Data

US 2009/0175415 A1 Jul. 9, 2009

Related U.S. Application Data

(62) Division of application No. 10/570,190, filed on Oct. 4, 2006, now Pat. No. 7,675,029.

(51) Int. Cl.
*G01V 5/00* (2006.01)
*G01F 23/00* (2006.01)
*G01N 23/201* (2006.01)

(52) U.S. Cl. ..... 250/253; 250/358.1; 250/359.1; 250/360.1; 378/88

(58) Field of Classification Search ..... 250/253, 250/358.1, 359.1, 360.1; 378/86, 87, 88
See application file for complete search history.

(56) References Cited

U.S. PATENT DOCUMENTS 3,564,251 A 2/1971 Youmans
3,976,879 A 8/1976 Turcotte
4,093,854 A 6/1978 Turcotte et al.
4,780,858 A 10/1988 Clerke
4,883,956 A 11/1989 Melcher et al.
4,938,060 A 7/1990 Sizer et al.
5,686,674 A 11/1997 Lowry et al.
5,815,264 A * 9/1998 Reed et al. ..... 356/336
5,859,430 A * 1/1999 Mullins et al. ..... 250/255
2002/0043620 A1 * 4/2002 Tchakarov et al. ..... 250/269.1

* cited by examiner

*Primary Examiner*—David P Porta
*Assistant Examiner*—Mindy Vu
(74) *Attorney, Agent, or Firm*—Marger Johnson & McCollom, P.C.

(57) ABSTRACT

An apparatus for recording and displaying images of and identifying material types in a target object in a fluid carrying conduit includes a downhole unit. The downhole unit includes a controllable light source, the controllable light source structured to emit high energy photons. The downhole unit further includes a sensor unit structured to detect the high energy photons that are backscattered from the target object and to generate signals in response to the detected high energy photons. The apparatus also includes a control and display unit that includes a signal transmitter and a viewing screen structured to display at least one two-dimensional image that is generated using the signals from the sensor unit.

5 Claims, 1 Drawing Sheet

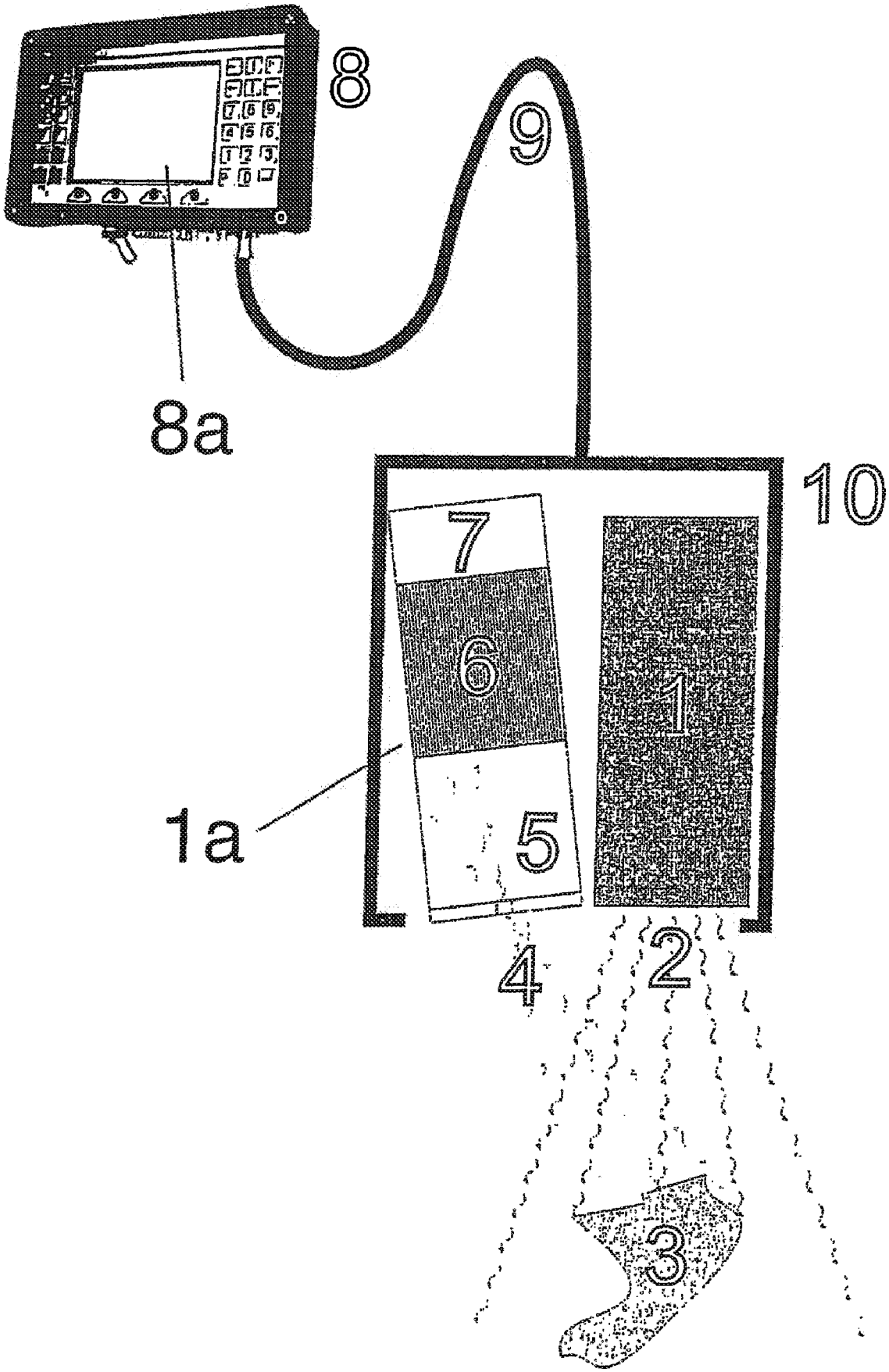
8
9
8a
10
7
6
1
1a
5
4
2
3

METHOD OF VISUALIZING TARGET OBJECTS IN A FLUID-CARRYING PIPE

CROSS-REFERENCE TO RELATED APPLICATIONS

This is a Divisional of U.S. application Ser. No. 10/570,190, filed on Oct. 4, 2006, now pending, which claims priority from International Application No. PCT/NO2004/000252, filed on Aug. 26, 2004, which in turn claims priority from Norwegian Patent Application No. 20043504, filed on Aug. 23, 2004, and Norwegian Patent Application No. 20033832, filed on Aug. 29, 2003. International Application No. PCT/NO2004000252 and Norwegian Patent Application Nos. 20043504 and 20033832 are incorporated by reference.

BACKGROUND

1. Technical Field

This disclosure relates to an apparatus and a method for providing an accurate image of a target object in a fluid-carrying pipe and more particularly, to an apparatus and method for providing an accurate image of a target object in an exploration or production well or in a pipeline carrying fluids such as hydrocarbons or aqueous liquids, and provides the opportunity of accurately determining which types of material said target object is composed of.

2. Description of the Related Art

For purposes of this disclosure, the term "fluid" is defined as any form of liquid and/or gas, separately or mixed. For purposes of this disclosure, the term "see" or "seeing" is defined as making image recordings that can be viewed by the human eye immediately or at a later stage, using, for example, a viewing screen.

The environment in exploration and production wells for oil and gas generally prohibits the use of video cameras due to the presence of saline solutions, mud, hydrocarbons and other substances that prevent the passage of visible light. Consequently, the possibility of seeing in such an environment by using a video camera is highly limited, due to the normal mixture of substances in the well. This very often results in time-consuming and costly inspections of well formations and equipment, and also fishing operations directed at the removal of unwanted objects in exploration and production wells.

Currently there exists no apparatus capable of seeing the targets under such conditions. However, the possibility of seeing in such environments is highly advantageous in terms of fulfilling the requirements for identification and localization of possible material damage and/or undesirable objects that have been lost or are stuck in the borehole.

U.S. Pat. No. 6,078,867 describes a system that produces a three-dimensional image of a borehole by means of a four-armed (or more) downhole caliper and gamma rays.

U.S. Pat. No. 4,847,814 describes a system for creating three-dimensional images by using data from a scan of a borehole carried out by use of a rotary acoustic transducer.

EP 1070970 describes a method of three-dimensional reconstruction of a physical quantity from a borehole comprising the creation of a three-dimensional image by measuring a first physical quantity as a function of depth, then to be compared with a second item.

WO 9935490 describes an apparatus and a method of depicting a lined borehole by means of ultrasound.

U.S. Pat. No. 5,987,385 describes an acoustic logging tool for creating a peripheral image of a borehole or a well lining by means of ultrasound generated by several transmitters/receivers mounted substantially in the same plane in the end piece of a drill string.

U.S. Pat. No. 4,821,728 describes a three-dimensional imaging system for representation of objects scanned by ultrasound.

U.S. Pat. No. 3,564,251 describes the use of radioactive radiation to establish information about the distance from the apparatus to the surroundings, e.g. a well wall, by creating a radial graph centered on the center of the apparatus.

Available radiation types for imaging applications range from radio waves to visible light to gamma rays. The wavelength of long-wave radiation in the form of radio waves ($>1\times10^{-1}$ m) is too great to create focused images that fulfill the necessary requirements. Short-wave radiation in the form of gamma rays ($<1\times10^{-11}$ m) has a wavelength and an energy level that gives sufficient image quality, but unfortunately requires a radiation source in the form of a radioactive material, which is out of the question in the environment of exploration and productions wells for oil and gas.

Embodiments of the invention address these and other disadvantages of the conventional art.

BRIEF DESCRIPTION OF THE DRAWINGS

The FIGURE is a schematic diagram illustrating an apparatus according to some embodiments of the invention.

DETAILED DESCRIPTION

The FIGURE is a schematic diagram illustrating an apparatus according to some embodiments of the invention.

A downhole unit 10 includes a cooling unit (not shown), a light source 1 and a sensor unit 1*a* consisting of a scatter limiting aperture 5, a scintillator/amplifier unit 6 and a charge coupled device (CCD) or a photodiode assembly (PDA) 7. The light source 1 produces high-energy photons 2 having a wavelength greater than $1\times10^{-11}$ m (0.01 nanometers). Preferably, embodiments use light sources that emit high-energy photons having a wavelength between $1\times10^{-11}$ m (0.01 nanometers) and $1\times10^{-8}$ m (10 nanometers). Rays having a wavelength between $1\times10^{-8}$ m and $1\times10^{-11}$ m have the desired effect both in terms of image quality and the energy level for penetration of relevant fluids.

The photons illuminate a downhole target object 3. Photons that result from bireflection 4 (i.e. reflection, decelerating radiation, scatter and/or Compton scatter) from the electron density of a downhole object 3 pass through the aperture 5 and interact with the surface of the scintillator/amplifier unit 6. The resulting photons, the majority of which have wavelengths of more than $1\times10^{-8}$ m (10 nanometers) due to the effect of the scintillator on the incident reflected radiation, interact with the cell composition of the CCD/PDA 7, producing a cellular electronic charge, the magnitude and character of which are proportional to the intensity of the spectral energy of the incoming photons 4.

The accumulated electronic charge that arises in the cells of the CCD/PDA 7 is collected in a holding buffer in the CCD 7, where the individual cellular electronic potentials are temporarily stored. The content of the buffer is then transmitted through a control/power cable 9 to a surface-mounted control and display unit 8 where a raster image is displayed on a viewing screen 8*a*. The process is continuous, with the CCD 7 being sampled and cleared several times per second.

The angle of the sensor unit 1*a* relative to the source 1 can be adjusted from the control and display unit 8 on the surface in order to determine the distance to the target object.

Any overall attenuation caused by high energy photons interacting with downhole fluids such as saline solutions, mud and hydrocarbons, can be filtered from the displayed image, either by increasing the clearing rate from the CCD 7 or by processing the image on the surface by means of the control and display unit 8.

The apparatus also provides the possibility of gathering spectral energy information from the incoming photons 4. The photons 4 carry information regarding the electron energy level of the atoms in the target object 3. Consequently, the distribution and magnitude of the received energy spectra can be processed versus spectra from a database for relevant types of material, these data being stored in the control and display unit 8 or possibly in an external data storage unit (not shown) that communicates with the control and display unit 8. The selection of the image area that is to be subjected to data comparison is carried out with appropriate, previously known means (not shown).

The conventional art offers the operators of well inspection equipment few opportunities to receive accurate visual feedback from the hole. Consequently, most operations are carried out blind, which is time consuming and entails a higher risk of material damage. In extreme cases the contents of the well must be removed and replaced with fluids that give better visibility for a video camera, which increases the overall cost of the well.

However, embodiments of the invention, such as those illustrated in the FIGURE, provide the operator with direct visual feedback without requiring any disturbances in the condition of the well (i.e. displacement of fluid and cleaning). Accordingly, use of the apparatus will entail a great reduction in labor and cost with a view to intervention operations. The possibility of receiving quick and realistic feedback represents an important advantage over the conventional art.

The apparatus also provides the possibility of gathering spectral energy information from the incoming photons 4. These photons 4 contain information regarding the electronic energy level of the atoms in the target object. Thus, the acquired data can be compared with known material data. This means that an operator of the equipment according to the invention can point and click on the target object such as it appears in the generated images and by so doing, obtain information regarding the material to be examined, such as scale (contamination), reservoir structure inspection, the effect of perforations and more.

Such information may be of inestimable value to operators who wish to know the composition of such materials without having to bring them up to the surface for a closer examination and laboratory testing. This may also be of particular benefit prior to a scale clean-up, where the likelihood of radioactive scale residue being brought to the surface is high. The apparatus allows such scale to be examined prior to cleaning up, so that the operator can prepare the receiving area in accordance with the nature of the material.

As a result of the nature of the apparatus and the possibility of creating images through downhole liners, the apparatus may obviously also be used to see behind liner walls.

In many instances, items may be dropped or jammed in the wellbore during intervention and drilling operations. Known pull-out or extraction techniques include the use of an indicator block that is conveyed into the hole to press against the dropped or jammed item in order to obtain an imprint of the top surface of the item. Examination of the imprint on the indicator block allows the operator to select the most appropriate gripping tool for extracting the item.

However, embodiments of the invention, such as those illustrated in the FIGURE, can quickly provide a dynamic image of the object, which offers advantageous information such as specific identification, the interface dimensions of the target object, contaminating deposits, possible damage to the well structure and the well conditions. Due to its flexibility the apparatus may also be integrated into or coupled directly to the pull-out tool, thus allowing identification and pull-out to be accomplished in a single operation.

The invention may be practiced in many ways. What follows are exemplary, non-limiting descriptions of some embodiments of the invention.

According to some embodiments of the invention, an apparatus combines known and novel technology in a novel manner with regard to sensors, electronics, software and assembly.

Some embodiments of the invention provide images of downhole target objects. Embodiments may use any type of high-energy photon sources to illuminate a target object in order to create an image of the object.

Some embodiments of the invention may be integrated in various types of downhole tools and make it possible to obtain visual information during critical operations. Preferably, the recorded measurement data are transmitted to a control unit on a continuous basis, allowing the images to be generated in near real time.

Alternatively, images may be obtained following a delayed transmission of the recorded measurement data, either through causing a suitable delay in the measurement data in a continuous signal transmission, or by storing the measurement data in a suitable medium for retrieval at a later time, e.g., after retrieving the measuring apparatus from the measurement area.

Some embodiments of the invention provide the possibility of collecting spectral energy information from the target object. Consequently, this information may be compared with a database containing known spectral analysis information for the types of material in question.

Some embodiments of the invention may include components that are required to generate images from a fluid-carrying pipe in which known video camera technology can not be used due to the inability of ordinary light to penetrate the fluid contents of the pipe.

According to some embodiments of the invention, a method includes generating an image of a downhole target object by producing high-energy photons that are subsequently detected by bireflection from the surface and internal structures of the target object. The photons have an energy that allows transmission of said photons through materials with a low electron density, such as mud, saline solutions, hydrocarbons and more. The method includes converting the reflected and detected photons into images that can be displayed on a viewing screen.

According to some embodiments of the invention, an apparatus is structured to generate an image of a downhole target object by producing high-energy photons that are subsequently detected by bireflection from the surface and internal structures of the target object. The photons have an energy that allows transmission of said photons through materials with a low electron density, such as mud, saline solutions, hydrocarbons and more. The apparatus is structured to convert the reflected and detected photons into images that can be displayed on a viewing screen.

According to some embodiments of the invention, an apparatus includes a control unit disposed on a surface, a downhole source and recording unit, and a signal/power cable between the control unit on the surface and the downhole source and recording unit.

According to alternative embodiments of the invention, an apparatus includes a downhole source and recording unit with start/stop controlled by a time switch, a pressure sensor, or a hydroacoustic receiver or similar device, and a control unit on the surface.

Embodiments of the invention may also be used actively in fishing operations where items require either activation or extraction to the surface. Thus the apparatus allows considerable advantages in terms of costs and safety, and provides the operator with the possibility of receiving visual feedback on the execution of the operation. Therefore the risk of material damage will be reduced, while the speed at which the operation is carried out can be increased.

Embodiments of the invention may also be used as a means of conveyance in order to carry other sensors such as temperature, pressure and flow sensor assemblies, thus forming a downhole diagnostic tool.

According to some embodiments, an apparatus for recording and displaying images of and identifying material types in a target object in a fluid-carrying pipe includes a downhole unit provided with a light source that is arranged to emit high energy photons. The downhole unit is further provided with a sensor unit arranged to register photons that are reflected from the target object. The apparatus further includes a control and display unit provided with a signal transmission means and a viewing screen. The apparatus may be used to record and display images of the target object.

A person skilled in the art will be able to practice the invention in view of the above description, which is to be taken as a whole. Numerous details have been set forth in order to provide a more thorough understanding of the invention. In other instances, well-known features have not been described in detail in order not to obscure unnecessarily the invention.

While the invention has been disclosed in its preferred form, the specific embodiments disclosed and illustrated above are not to be considered in a limiting sense, but rather as exemplary embodiments. Indeed, it should be readily apparent to those skilled in the art that the exemplary embodiments described above may be modified in numerous ways without departing from one or more of the inventive principles that are present in the exemplary embodiments. The inventors regard the subject matter of the invention to include all combinations and subcombinations of the various elements, features, functions and/or properties that are disclosed in this specification.

The invention claimed is:

1. A method of recording and displaying images of and identifying material types in a target object disposed inside a fluid-carrying conduit, the method comprising:

emitting high-energy photons from a controllable light source towards the target object;

registering photons that are backscattered from the target object using a sensor having a scatter limiting aperture, an amplifier, and an image registering device structured to generate cellular electronic charges in response to the registered photons;

transmitting image data to a control and display unit via a buffer memory integrated in the image registering device, the image data corresponding to the cellular electronic charges;

generating images on a screen in response to the transmitted image data; and comparing selected image data with a material database for determining the material composition of the target object by spectroscopic analysis of the returning photons.

2. The method of claim 1, wherein emitting the high-energy photons comprises emitting photons having a wavelength corresponding to x-ray radiation.

3. The method of claim 1, wherein emitting the high-energy photons comprises emitting photons having a wavelength corresponding to gamma radiation.

4. The method of claim 1, wherein transmitting the image data occurs in near real time.

5. The method of claim 1, wherein transmitting the image data occurs after an arbitrary time lag.

* * * * *